US007080499B2

(12) United States Patent
Giuliano

(10) Patent No.: US 7,080,499 B2
(45) Date of Patent: Jul. 25, 2006

(54) MACHINE AND METHOD FOR PRODUCING CHENILLE YARNS

(75) Inventor: Sostegni Giuliano, Fiorentino (IT)

(73) Assignee: Giesse S.R.L., Florence (IT)

( * ) Notice: Subject to any disclaimer, the term of this patent is extended or adjusted under 35 U.S.C. 154(b) by 69 days.

(21) Appl. No.: 10/875,835

(22) Filed: Jun. 24, 2004

(65) Prior Publication Data

US 2005/0016155 A1 Jan. 27, 2005

(30) Foreign Application Priority Data

Jul. 25, 2003 (IT) ..... FI20030069 U

(51) Int. Cl.
*D02G 3/42* (2006.01)

(52) U.S. Cl. ..... 57/24

(58) Field of Classification Search ..... 57/24, 57/203

See application file for complete search history.

(56) References Cited

U.S. PATENT DOCUMENTS 5,748,481 A * 5/1998 Nakade ..... 700/143
6,119,444 A * 9/2000 Sostegni ..... 57/24

* cited by examiner

*Primary Examiner*—Shaun R. Hurley
(74) *Attorney, Agent, or Firm*—McGlew & Tuttle, PC

(57) ABSTRACT

A machine and a method for producing chenille yarns is provided; the machine comprises yarn-forming parts and spooling parts directly downstream disposed, and an apparatus for controlling the quality of yarns located between the yarn-forming parts and the spooling parts.

9 Claims, 4 Drawing Sheets

MACHINE AND METHOD FOR PRODUCING CHENILLE YARNS

The present invention refers to a machine and a method for producing chenille yarns.

BACKGROUND OF THE INVENTION

It is known that the yarns produced by chenille-forming machine are collected onto spindles intended to feed yarn—upon a step performed in a station separately from the formation of yarns—to spooling means by which reels are formed for use in machines for the production of chenille products. During the spooling step, the yarn unreeling from each spindle towards the spooling station, is subjected to quality control by using optoelectronic means which provide for signalling possible yarn defects such as, for example, the lack of lengths of fuzzy thread.

A drawback connected to the implementation of this technique lies in the fact that a systematically defective yarn production is detected only during the spooling step, that is, with excessive delay.

SUMMARY OF INVENTION

The main object of the present invention is to overcome the above said drawback.

This result has been achieved, according to the invention, by providing a machine and a method having the characteristics of a machine for producing chenille yarns, including at least one chenille yarn-forming unit having mechanism to feed two pairs of interweaving threads intended to retain lengths of a fuzzy thread, and further including a twisting unit from which a third interweaving thread is delivered, and a machine that includes a optoelectric machinery for controlling a prolonged absence of lengths of fuzzy threads located between the yarn-forming units and the spooling units, wherein the spooling units are disposed directly downstream of the optoelectric control mechanism.

Further characteristics being set forth by the machine described above, wherein the yarn-forming units are yarn-forming units for the formation of chenille yarns with three interweaving threads.

Optionally, the machine described above may also include the described machinery for controlling the quality of yarns which are optoelectronic-based.

Additionally, a method for producing chenille yarns is provided, which includes the steps of forming chenille yarn having three interweaving threads and lengths of a fuzzy thread retained therebetween: direct spooling of the chenille yarn after the yarn-forming step; and controlling a prolonged absence of lengths of fuzzy threads in order to control the quality of the chenille yarns, method in which the step of quality control is performed immediately before the spooling step.

The advantages deriving from the present invention lie essentially in that it is possible to control in real time the quality of the produced yarn, to interrupt the production when the controlled characteristics of the yarn are unsatisfactory, and to avoid prolonging exceedingly the production of the faulty yarn. Besides, by providing for a direct spooling of the yarn allows eliminating the times and relevant costs associated with the transfer of the spindles. In addition to this, a machine according to the invention is of relatively simple construction.

BRIEF DESCRIPTION OF THE DRAWINGS

These and other advantages and characteristics of the invention will be best understood from a reading of the following description in conjunction with the attached drawings given as a practical exemplification of the invention, but not to be considered in a limitative sense, wherein.

DETAILED DESCRIPTION OF THE INVENTION

Figure 1:
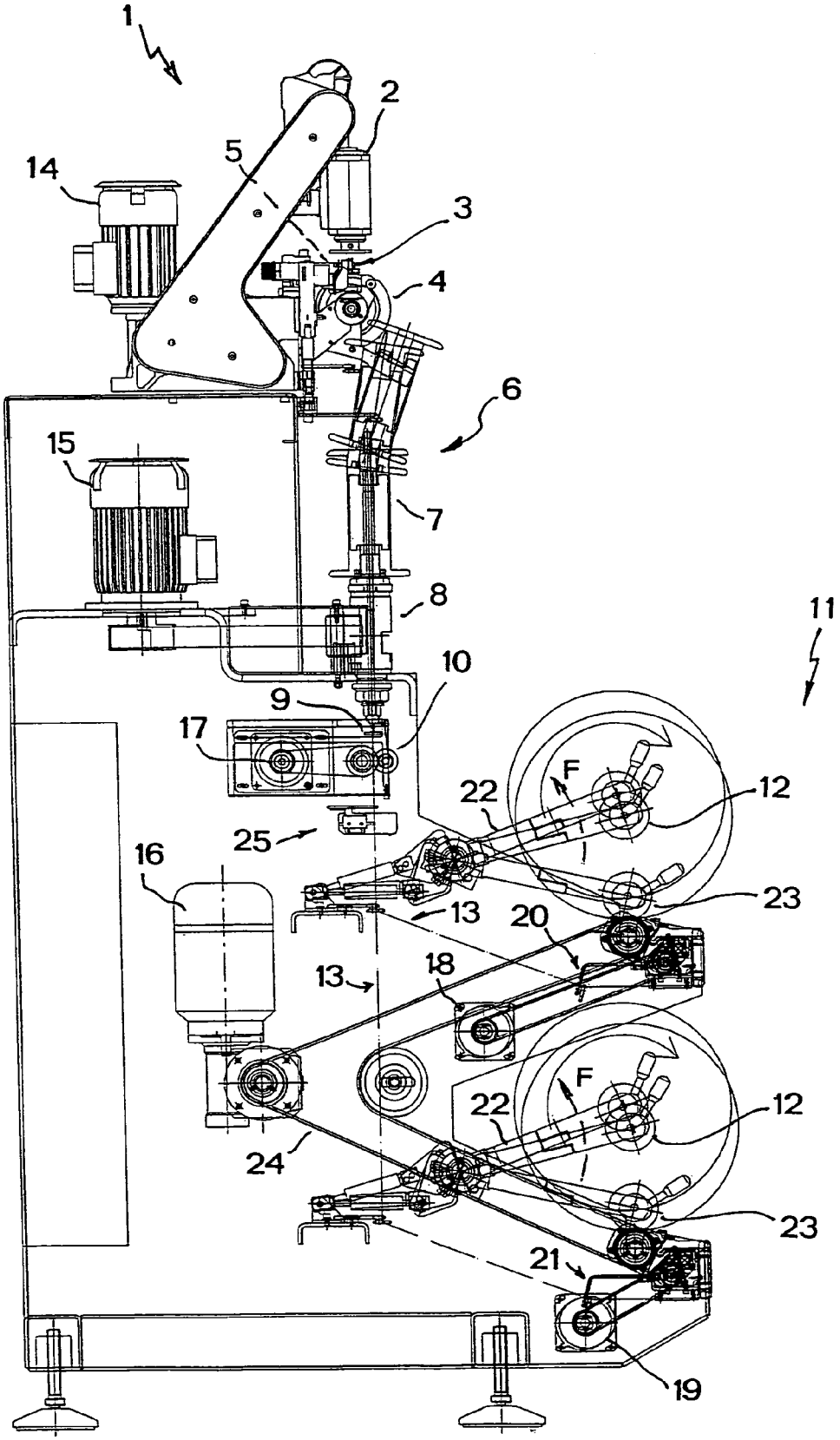
FIG. 1 is a schematic side view of a machine according to the invention.

Reduced to its basic structure and reference being made to the accompanying drawings, a machine according to the present invention comprises:

- a unit (1) to produce a pair of chenille yarns, with a head (2) for feeding a fuzzy thread to be wound over an underlying gauge (3) below which a circular blade (4) is located for cutting the fuzzy thread, wound over the gauge (3), into lengths of preset extension, and with two rollers (5) located sideway of the gauge (3) and feeding two pairs of interweaving threads intended to retain, as a consequence of their torsion, the lengths of fuzzy thread generated by the blade (4) in correspondence of the gauge (3);
- a twisting unit (6) located below said interweaving and fuzzy threads-processing unit (1), with a hollow spindle (7) for each chenille thread, which extends to form a roll (8) from which a third interweaving thread is delivered: each hollow spindle (7) having a corresponding chenille thread going therethrough to come out of it, interwoven to said third interweaving thread, by passing through an underlying spiral-shaped thread-guide (9) and two horizontal rollers (10) which recall the third interweaving thread delivered by said roll (8);
- a spooling unit (11), directly disposed downstream of said twisting unit (6), with two horizontal frustoconical cores (12) around which the threads (13), produced in cooperation with said units (1) and (6), collect on relevant single cores.

Such a structure is described in greater detail in the Italian Patent 242.695. In FIG. 1, numerals (14, 15, 16) indicate, respectively, the motors for driving the first (1), second (6) and third (11) units; numeral (17) indicates a motor for driving the rollers (10); and numerals (18) and (19) designate two independent motors for driving relevant thread-guides (20, 21) which are located proximate to the spooling cores (12) and, by translating bi-directionally and parallel to the axis of the same cores, allow collecting the cross-loop yarns (13).

Figure 2:
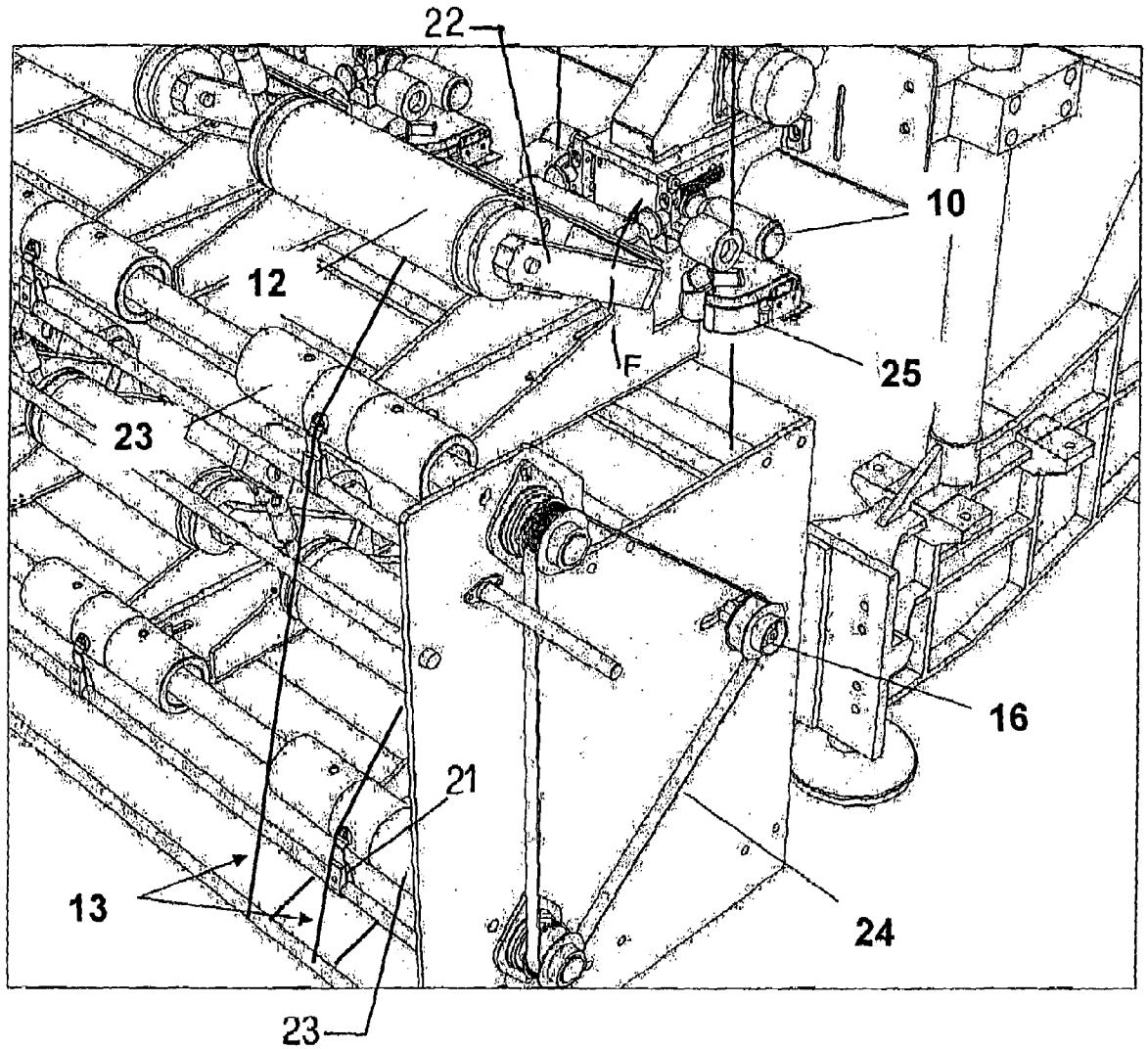
FIG. 2 is a schematic perspective view of the second operating unit (11)

The said cores (12) are supported by respective arms (22) which pivot about respective anchoring points, as shown by the arrow (F) in FIG. 2 and FIG. 1, as the diameter of the reels gradually increases.

The rotation of the reels upon the collection of the yarns (13) is obtained by the contact thereof with corresponding horizontal rollers (23) associated with the said motor (16) by means of a belt drive (24).

In FIG. 2, for sake of clarity, it is not shown the cross-loop yarns (13) collected on the cores (12). Furthermore, in FIG. 2 the belt (24) follows a different path with respect to that shown in FIG. 1.

Advantageously, according to the present invention, a quality-control photocell (25) is provided for each yarn (13) disposed at a preset point between the said second operating unit (6) and the said third operating unit (11), so that each yarn (13) is subjected to a continuous quality inspection before being wound up onto the respective reel.

Figure 3:
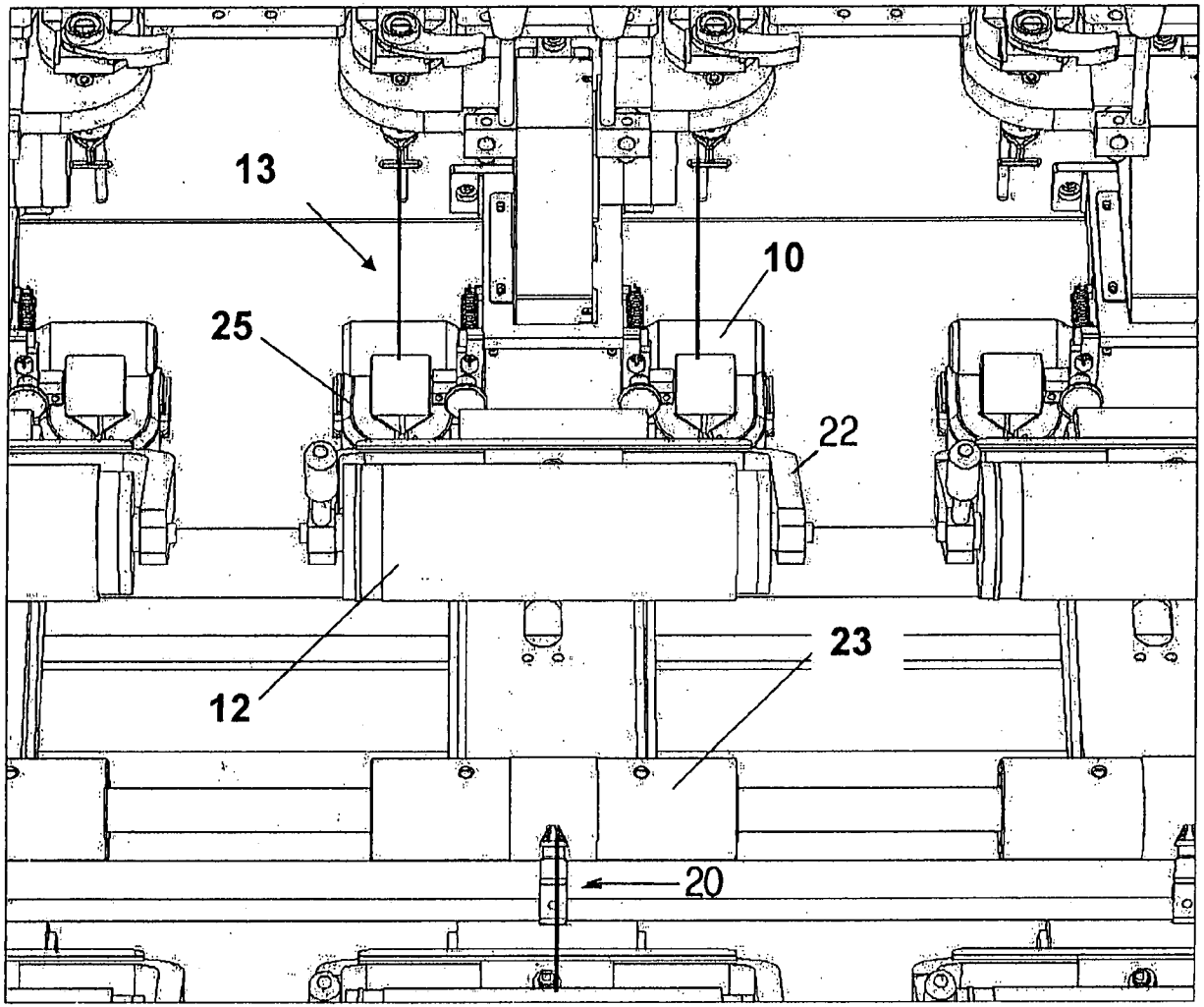
FIG. 3 is a schematic perspective view of the area between the first and second operating units.
Figure 4:
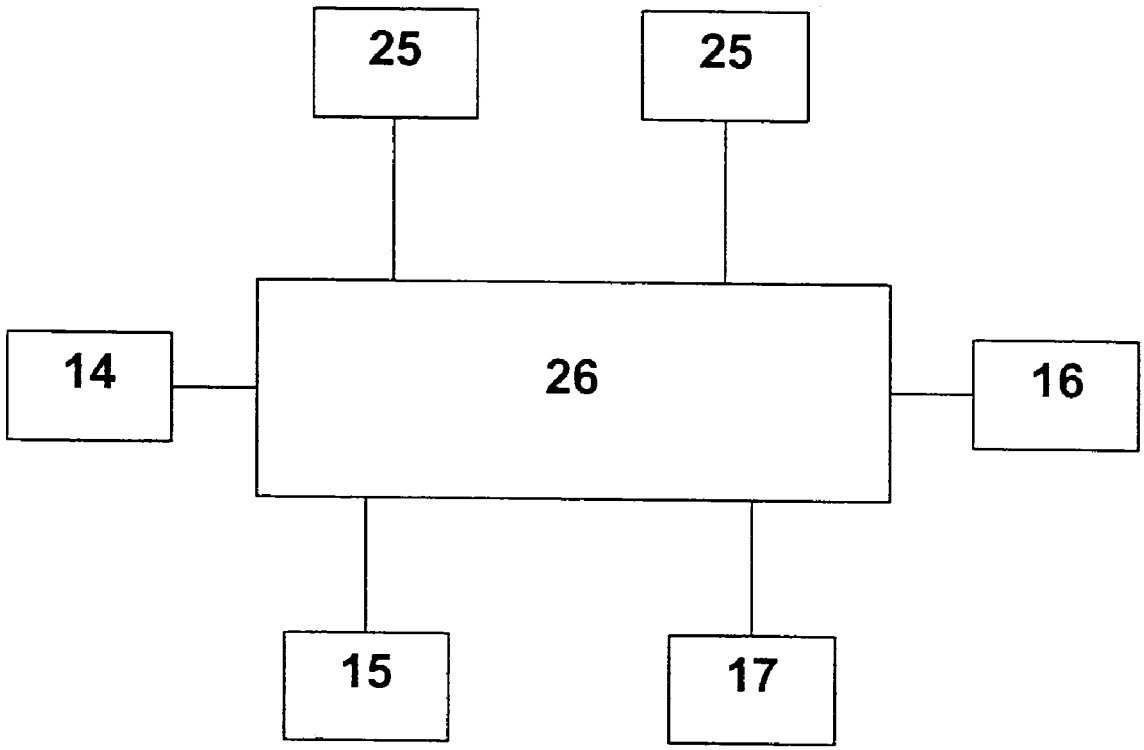
FIG. 4 is a simplified block diagram of the flaw-control system.

In FIG. 3, the path of each yarn (13) is shown only partially for sake of clarity.

Each photocell (25) is connected with a programmable electronic unit (26) with which the motors of the relevant operating units are associated: in case the characteristics of the yarns (13) sensed by the photocells (25) are unsatisfactory, the production is immediately cut off to allow eliminating the source of the detected flaw and to prevent the defective yarn from being wound over the reel.

For example, the yarns (13) might result defective because of the a prolonged absence of lengths of fuzzy threads due to a poor distribution thereof or to a breaking of the third interweaving thread.

For example, the said photocell (25) may be of a type produced by the Italian Company ITECO and designated by code number 832003321 with associated accessories (code number 8320311) and control unit (code number 83203301).

A machine according to the invention may comprise one or more units (1, 6, 11) side-by-side disposed.

As described above, the photocells (25) are advantageously positioned between the yarns (13)—producing or forming section and the spooling section which is directly disposed downstream the producing section. This arrangement allow a more rational utilization of the chenille-producing machine in general, while eliminating the drawbacks connected with the traditional discontinuity of the processes for the formation, quality-control and spooling of the yarns.

A method according to the present invention comprises the steps of chenille yarn-forming, direct spooling of the chenille yarn immediately after the yarn-forming step and controlling the quality of the chenille yarns. The said step of quality control is performed before said spooling step.

It will be appreciated that this novel concept is applicable to chenille-forming machines comprising chenille yarn-forming units of any possible construction Moreover, the construction details may vary in any equivalent way as far as the shape, dimensions, elements disposition, nature of the used materials are concerned, without nevertheless departing from the scope of the adopted solution idea and, thereby, remaining within the limits of the protection granted to the present patent.

What is claimed is:

1. A machine for producing chenille yarns, comprising:

at least one chenille yarn-forming unit including a feeding means to feed two pairs of interweaving threads contorted to retain lengths of a fuzzy thread, and further comprising a twisting unit from which a third interweaving thread is delivered;

a quality control machine that comprises an optoelectric means for controlling and preventing a prolonged absence of said lengths of fuzzy threads, said optoelectric means located between said yarn-forming unit and a spooling means, wherein said spooling means is disposed directly downstream of said optoelectric means.

2. The machine of claim 1, wherein said yarn-forming unit forms chenille yarns with three interweaving threads directly upstream of said quality control machine.

3. The machine of claim 1, wherein said quality control machine for controlling the quality of yarns is a photocell.

4. A method for producing chenille yarns, comprising the steps of:

supplying three interweaving threads and lengths of a fuzzy thread;

forming chenille yarn having said three interweaving threads and said lengths of a fuzzy tread retained therebetween;

direct spooling of said chenille yarn after the yarn-forming step; and controlling and preventing a prolonged absence of said lengths of a fuzzy threads in order to control the quality of said chenille yarns, method in which said step of quality control is performed immediately before said spooling step.

5. A chenille yarns producing machine comprising:

an interweaving and fuzzy threads-processing unit including a head for feeding a fuzzy thread to be wound over an underlying gauge and a circular blade for cutting said fuzzy thread, wound over said gauge, into lengths of preset extension, and including two side rollers located sideways of said gauge, each of said side rollers feeding a pair of interweaving contorted threads retaining through torsion, the lengths of said fuzzy thread cut by said blade;

a twisting unit located downstream of said interweaving and fuzzy threads-processing unit, said twisting unit including a pair of hollow spindles extending to an area near a single roll from which a third interweaving thread is delivered and, each hollow spindle guiding each respective said contorted threads going through to come out of it, and interwoven to said third interweaving thread, by passing through an underlying spiral-shaped thread-guide and two horizontal rollers;

a quality control photocell disposed directly downstream of said twisting unit continuously inspecting and preventing a prolonged absence of said lengths of fuzzy threads before being wound up onto a respective final horizontal frusto-conical core ready for commercialization; and a spooling unit directly disposed directly downstream of said quality control photocell, with two said horizontal frusto-conical cores around which said interwoven threads collect.

6. A chenille yarns producing machine according to claim 5, wherein said photocell is connected with a programmable electronic unit for immediately cutting off motors of the chenille yarns producing machine in case the characteristics of the yarns are unsatisfactory.

7. A chenille yarns producing machine according to claim 5, wherein said interweaving and fuzzy threads-processing unit, said twisting unit, and said spooling unit are disposed side by side.

8. A chenille yarns producing machine according to claim 5, wherein said cores are supported by respective arms which pivot about respective anchoring points, as the diameter of said cores gradually increases.

9. A chenille yarns producing machine according to claim 5, wherein the rotation of said cores upon the collection of the yarns is obtained by the contact thereof with corresponding horizontal rollers.

* * * * *